US005868088A

United States Patent [19]

Mori et al.

[11] Patent Number: 5,868,088

[45] Date of Patent: Feb. 9, 1999

[54] SEWING MACHINE FACILITATING STORAGE OF EMBROIDERY ATTACHMENT

[75] Inventors: Tomohiko Mori; Seijiro Okuda, both of Nagoya, Japan

[73] Assignee: Brother Kodyo Kabushiki Kaisha, Nagoya, Japan

[21] Appl. No.: 805,148

[22] Filed: Feb. 24, 1997

[30] Foreign Application Priority Data

Feb. 22, 1996 [JP] Japan ..... 8-035078

[51] Int. Cl.[6] ..... D05B 21/00

[52] U.S. Cl. ..... 112/102.5; 112/275; 112/470.04

[58] Field of Search ..... 112/470.06, 102.5, 112/470.04, 103, 275, 277, 475.19

[56] References Cited

U.S. PATENT DOCUMENTS

| | | | |
|---|---|---|---|
| 3,986,466 | 10/1976 | Herzer et al. | 112/102.5 |
| 4,135,459 | 1/1979 | Manabe et al. | 112/102.5 |
| 4,688,498 | 8/1987 | Carlson | 112/103 X |
| 5,040,476 | 8/1991 | Takenoya et al. | 112/470.06 |
| 5,284,104 | 2/1994 | Hori et al. | 112/102.5 |
| 5,386,789 | 2/1995 | Futamura et al. | 112/103 X |

FOREIGN PATENT DOCUMENTS

| | | |
|---|---|---|
| B2-63-64993 | 12/1988 | Japan . |
| B2-63-64994 | 12/1988 | Japan . |
| A-4-364887 | 12/1992 | Japan . |

*Primary Examiner*—Peter Nerbun
*Attorney, Agent, or Firm*—Oliff & Berridge, PLC

[57] ABSTRACT

A sewing machine having an embroidery frame and a drive unit for driving that frame with respect to the sewing needle, wherein the area occupied by the frame and drive unit can be reduced for storage. To do this, the user presses a storage button on an LCD touch panel screen. The CPU determines that a command has been given to reduce the area of the frame and drive unit for storage; calculates the amount of drive necessary to move the embroidery frame from its current position stored in nonvolatile memory to the position used for storing the drive unit; and controls drive motors to move the embroidery frame the distance calculated, reducing the overall area occupied by the frame and drive unit.

23 Claims, 9 Drawing Sheets

SEWING MACHINE MOTOR
24
NEEDLE BAR SWING DRIVE MOTOR
27
FEED DOG DRIVE MOTOR
28
LCD
20
X-DIRECTION MOVEMENT MOTOR
44
Y-DIRECTION MOVEMENT MOTOR
40
16
30
OUTPUT INTERFACE
CPU
26
ROM
28
NONVOLATILE MEMORY
25
RAM
30
CARD ROM
34
INPUT INTERFACE
START/STOP SWITCH
32
TOUCH PANEL
18

SEWING MACHINE FACILITATING STORAGE OF EMBROIDERY ATTACHMENT

BACKGROUND OF THE INVENTION

1. Field of the Invention

The present invention relates to a sewing machine mounted with a support frame drive unit for moving a workpiece cloth.

2. Description of the Prior Art

The sewing machine detachably mounted with a support frame drive unit (hereinafter referred to simply as "drive unit") has been described in Japanese Laid-Open Patent Publication No. HEI-4-364887. In this Laid-Open Patent Publication, as shown in the explanatory diagrams shown in FIGS. 9(*a*) and 9(*b*), a workpiece cloth is supported by an embroidery frame 102 on the drive unit 100. The embroidery frame 102 is attached to a support portion. This support portion is moved in the front-and-back direction by a Y-direction movement mechanism 104. The Y-direction movement mechanism 104 moves in the left-and-right direction according to an X-direction movement mechanism. The Y-direction movement mechanism 104 is exposed on the external part of the drive unit 100, while the X-direction movement mechanism is provided inside the drive unit 100. Thus, when the drive unit 100 is removably mounted on the sewing machine, the embroidery frame 102 can be moved forward and backward or left and right beneath the vertically moving sewing machine needle.

Recently, large embroidery patterns have become fashionable. Thus, the movement ranges of the X-direction movement mechanism and the Y-direction movement mechanism 104 have been expanded along with the embroidery frame 102. The drive unit 100 itself has been made larger in order to accommodate these larger embroidery patterns. However, since a considerable amount of space is required to store the sewing machine when it is mounted with the drive unit 100, in some cases it is more suitable to separate the two. In addition, the sewing machine is sometimes stored with the embroidery frame 102 attached to the drive unit 100 to eliminate both the possibility of losing the embroidery frame 102 and the trouble required to remove and attach the same from the drive unit 100.

However, when the sewing machine is stored with the embroidery frame 102 attached to the drive unit 100, as described above, the area in which the embroidery frame 102 and drive unit 100 overlap is small, and the surface area (seen from above, as in FIG. 9(*a*)) occupied by the embroidery frame 102 and the drive unit 100 is large. Thus, a large area is occupied by the drive unit 100. A very large amount of space will be necessary particularly if a large embroidery frame 102 is attached to the drive unit 100.

The dimensions X1 and Y1 of FIG. 9(*a*), for example, are longer than the respective dimensions X2 and Y2 of FIG. 9(*b*). Thus, the drive unit 100 in the state shown in FIG. 9(*a*) requires more width and depth than the drive unit 100 shown in FIG. 9(*b*).

Hence, if the drive unit 100 is set next to a wall or other objects, the embroidery frame 102 and the drive unit 100 must be positioned in such a way as not to bump against the wall or other objects. In addition, the drive unit 100 might not fit into an area if a part attached externally to the drive unit 100 that moves with the embroidery frame 102 (the Y-direction movement mechanism 104, for example) is not in a suitable position.

SUMMARY OF THE INVENTION

In view of the above descriptions, it is an object of the present invention to provide a sewing machine with a support frame drive unit that can easily be stored.

To achieve the above and other objects, there is provided, according to one aspect of the invention, a sewing machine that includes a sewing machine body, a needle vertically movable for stitching a workpiece cloth, a support frame for supporting the workpiece cloth, a support frame drive unit, and a control means. The support frame drive unit has a frame movement mechanism for moving the support frame with respect to the needle. The support frame drive unit is detachably connected to the sewing machine body. The control means controls the frame movement mechanism so as to reduce an area occupied by the support frame drive unit and the support frame.

A manual operation button is further provided, which, when pressed, inputs a start instruction into the control means for causing the control means to start reduction of the area occupied by the support frame drive unit and the support frame.

A storage means is also provided for storing an updated position of the support frame and a predetermined storage position. When the manual operation button is pressed, the frame movement mechanism moves the support frame from the updated position to the predetermined storage position. The storage means comprises a nonvolatile memory for storing the updated position of the support frame, whereby the updated position of the support frame remains unerased even if the sewing machine is powered off.

The storage means may store a plurality of different predetermined storage positions. In this case, when the manual operation button is pressed, the frame movement mechanism moves the support frame from the updated position to a selected one of the plurality of different predetermined storage positions.

There is also provided a set of manual frame movement keys for moving the support frame with respect to the needle. Also, a display is provided for displaying a positional relationship between the support frame drive unit and the support frame. A position to which the support frame drive unit is moved is settable with the set of manual frame movement keys while viewing the positional relationship between the support frame drive unit and the support frame displayed in the display. The frame movement mechanism moves the support frame to the position to reduce the area occupied by the support frame drive unit and the support frame.

When the support frame drive unit detached from the sewing machine body is to be stored in a storage container having an inner accommodating space, the control means controls the frame movement mechanism to move the support frame in a position where the support frame drive unit and the support frame are fittedly insertable into the inner accommodating space of the storage container.

According to another aspect of the invention, there is provided a sewing machine system that includes a needle vertically movable for stitching a workpiece cloth, a support frame for supporting the workpiece cloth, a support frame drive unit having an installation portion for installing the support frame and a support frame drive unit having a frame movement mechanism for moving the support frame with respect to the needle and the installation portion, a sewing machine body to which the support frame drive unit is detachably mounted, a storage container for containing the support frame drive unit after the support frame drive unit is detached from the sewing machine body, and control means for controlling the frame movement mechanism so as to provide the support frame drive unit in a predetermined condition for insertion into the storage container.

According to still another aspect of the invention, there is provided a sewing machine that includes a needle vertically movable for stitching a workpiece cloth, a support frame for supporting the workpiece cloth, a support frame drive unit having a frame movement mechanism for moving the support frame with respect to the needle, a sewing machine body to which the support frame drive unit is detachably mounted, setting means for setting a stop position of the frame movement mechanism, memory means for storing the stop position set by the setting means, and control means for stopping the frame movement mechanism according to the stop position stored by the memory means.

BRIEF DESCRIPTION OF THE DRAWINGS

The particular features and advantages of the invention as well as other objects will become apparent from the following description taken in connection with the accompanying drawings, in which:

FIG. 9(*b*) is a diagram showing a drive unit in a state appropriate for storage.

DETAILED DESCRIPTION OF THE PREFERRED EMBODIMENT

Figure 1:
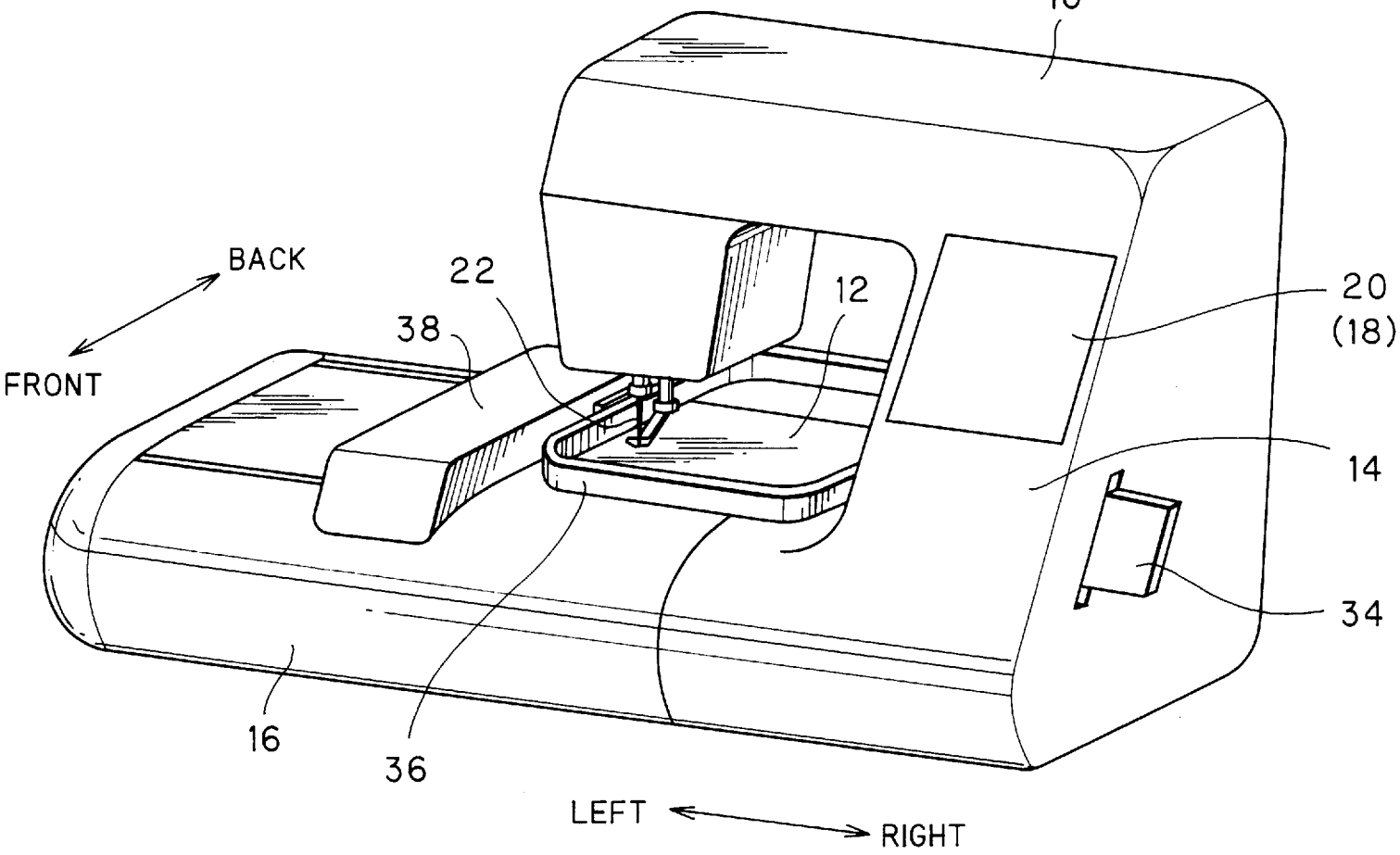
FIG. 1 is a diagram showing a sewing machine of the present invention in a state not suitable for storage.

A sewing machine according to a preferred embodiment of the present invention will be described while referring to the accompanying drawings.

First the configuration of a sewing machine 10 will be described. A shuttle mechanism (not shown in the diagrams) well known in the art is provided inside the bed portion 12, which is the base of the sewing machine 10. A column portion 14 is vertically provided on the right side of the bed portion 12. The left side portion of the bed portion 12 is configured to be mountable by a support frame drive unit 16 (hereinafter referred to as "drive unit 16") to be described later. A liquid crystal display (LCD) 20 is provided on the front of the column portion 14. A touch panel 18 is attached to the LCD 20. An arm portion is formed from the top of the column portion 14 to extend out over the bed portion 12. A sewing needle 22 is provided on the arm portion above the shuttle mechanism in such a way as to move vertically in cooperative operation with the shuttle. The shuttle mechanism and the sewing needle 22 are driven in synchronism with a sewing machine motor 24 and other drive motors internal to the sewing machine 10.

Figure 4:
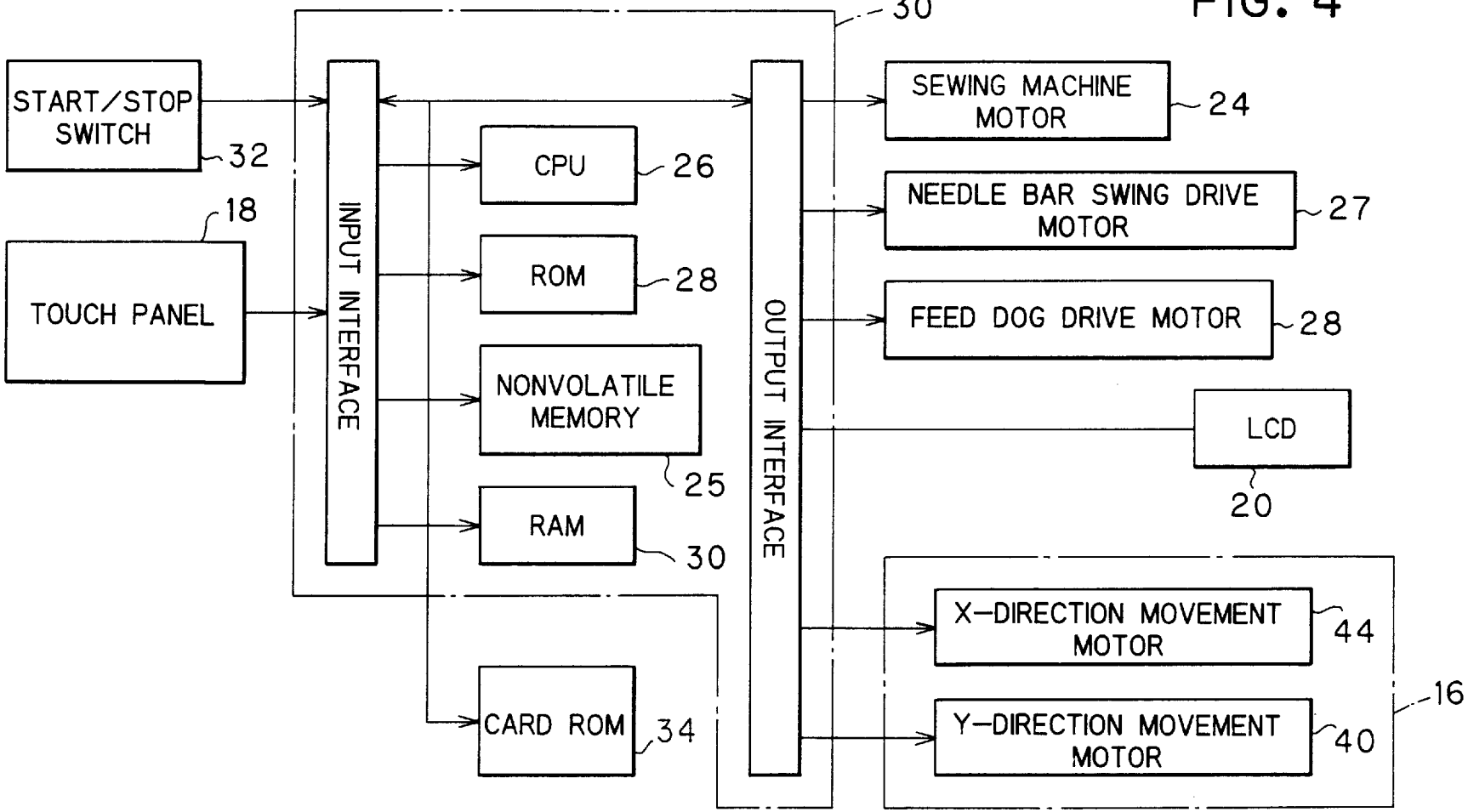
FIG. 4 is an electrical block diagram for a sewing machine of the present invention.

As shown in FIG. 4, the display of the LCD 20 is controlled by a CPU 26 of the control unit based on data stored in a ROM 28, internal memory. The sewing conditions of the sewing machine 10 are input into the CPU 26 by pressing buttons on the touch panel 18 according to information displayed on the LCD 20. The CPU 26 follows the program stored in the ROM 28 according to the conditions input, controlling the sewing machine motor 24 and the like. A RAM 30 internal to the sewing machine 10 is used by the CPU 26 for such controlling operations. According to the program stored in the ROM 28, a user can select embroidery patterns and issue an accommodation command by pressing buttons on the touch panel 18. A command for the sewing machine 10 to begin sewing is input to the CPU 26 when the user pushes the start/stop switch 32.

Recently, there has been a demand for large embroidery patterns or many embroidery patterns. However, since the internal memory of the sewing machine 10 is limited, the sewing machine 10 has been configured to accept a card ROM 34, which is an external memory medium. The CPU 26 sequentially reads embroidery data from the card ROM 34 and then controls the sewing machine motor 24 and the drive unit 16 according to that data. In addition, a nonvolatile memory 25 is provided inside the sewing machine 10 that sequentially stores the positions of the embroidery frame 36 and holds the position data even when the power source of the sewing machine 10 is turned off.

Next, the drive unit 16, which is removably mounted in the sewing machine 10, will be described.

The drive unit 16, which is L-shaped when viewed from the top, can be removably fitted into the bed portion 12. A Y-direction movement mechanism 38 is provided on the top surface of the drive unit 16. An embroidery frame 36 for supporting a workpiece cloth is removably attached to the Y-direction movement mechanism 38. When the drive unit 16 is mounted in the sewing machine 10, the CPU 26 controls a Y-direction movement motor 40 of the Y-direction movement mechanism 38, which moves the embroidery frame 36 in the front-and-rear direction, i.e., Y-direction, relative to the sewing machine 10. An X-direction movement mechanism is provided inside the drive unit 16 for moving the Y-direction movement mechanism 38 in the left-and-right direction relative to the sewing machine 10. When the drive unit 16 is fitted into the sewing machine 10, the CPU 26 controls an X-direction movement motor 44 of the X-direction movement mechanism. A detailed description of these devices will be omitted here as the same devices are described in Japanese Laid-Open Patent Publication No. HEI-4-364887.

Figure 5:
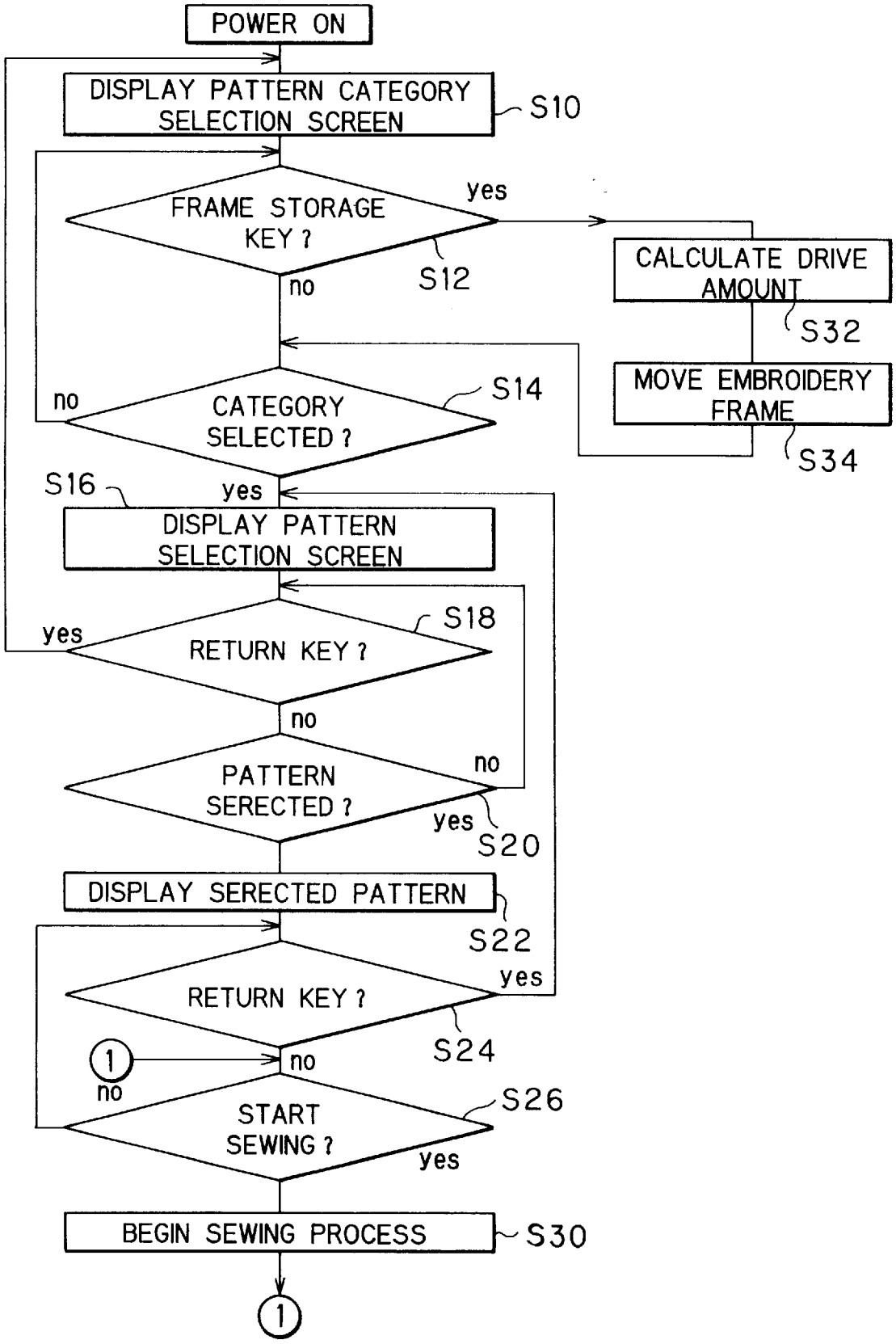
FIG. 5 is a flowchart of the present invention.

Next, operations for arranging the drive unit 16 in a condition for storage will be described with reference to the flowchart in FIG. 5.

Figure 6:
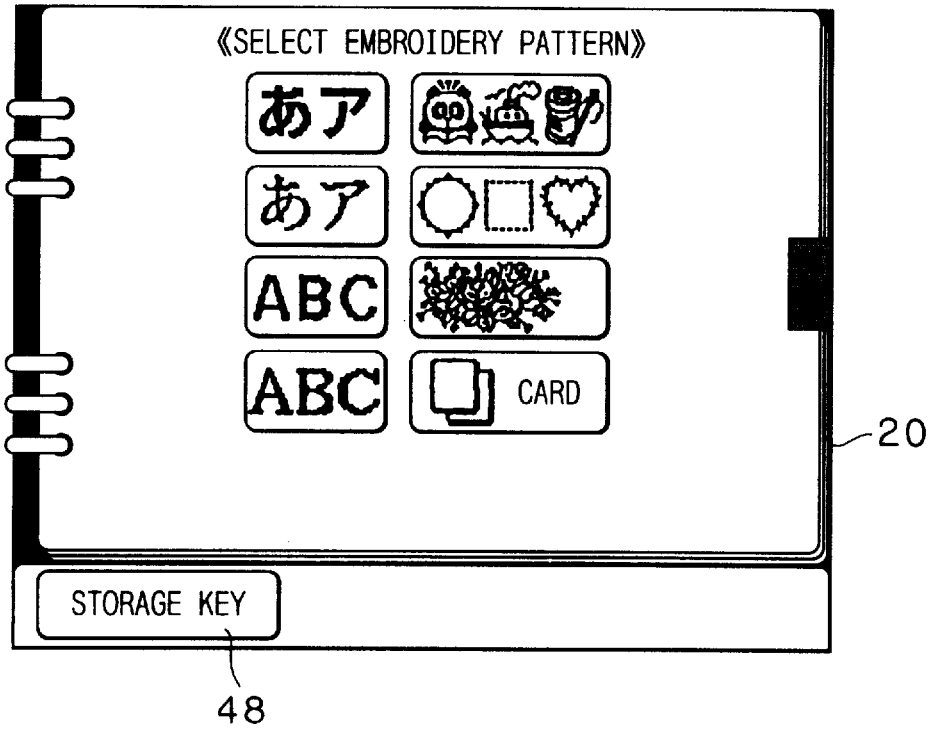
FIG. 6 is a diagram showing the display screen on a sewing machine of the present invention.
Figure 7:
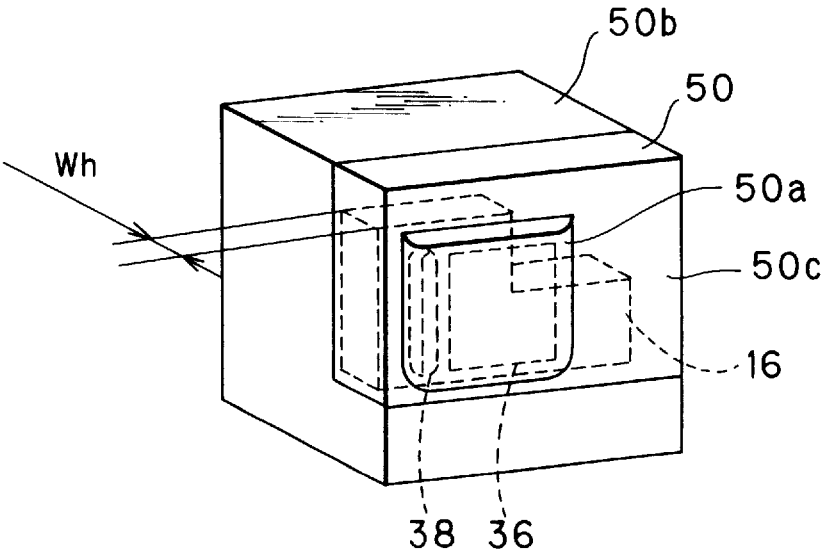
FIG. 7 is a diagram showing a storage container for a sewing machine and drive unit of the present invention.

The user fits the drive unit 16 and inserts the card ROM 34 into the sewing machine 10 and turns on the power source for the sewing machine 10. The CPU 26 displays on the LCD 20 the initial screen shown in FIG. 6 for selecting a category of embroidery patterns (S10). When a category is chosen (S14: yes), a screen for selecting embroidery patterns in that category is displayed (S16), allowing the user to choose a desired pattern. When a selection is made (S20: yes), the selected pattern is displayed (S22). At this point, if the user presses the start/stop switch 32 (S26: yes), the CPU 20 will drive the sewing machine motor 24, Y-direction movement motor 40, X-direction movement motor 44, and the like, based on data in the card ROM 34 (S30), causing the sewing needle 22 and embroidery frame 36 to move with respect to one another. The CPU 26 automatically and sequentially stores in the nonvolatile memory 25 the current positions of the embroidery frame 36 with respect to the sewing needle 22, in order that the current position is always saved even if the power is turned off.

Figures 9A, 9B:
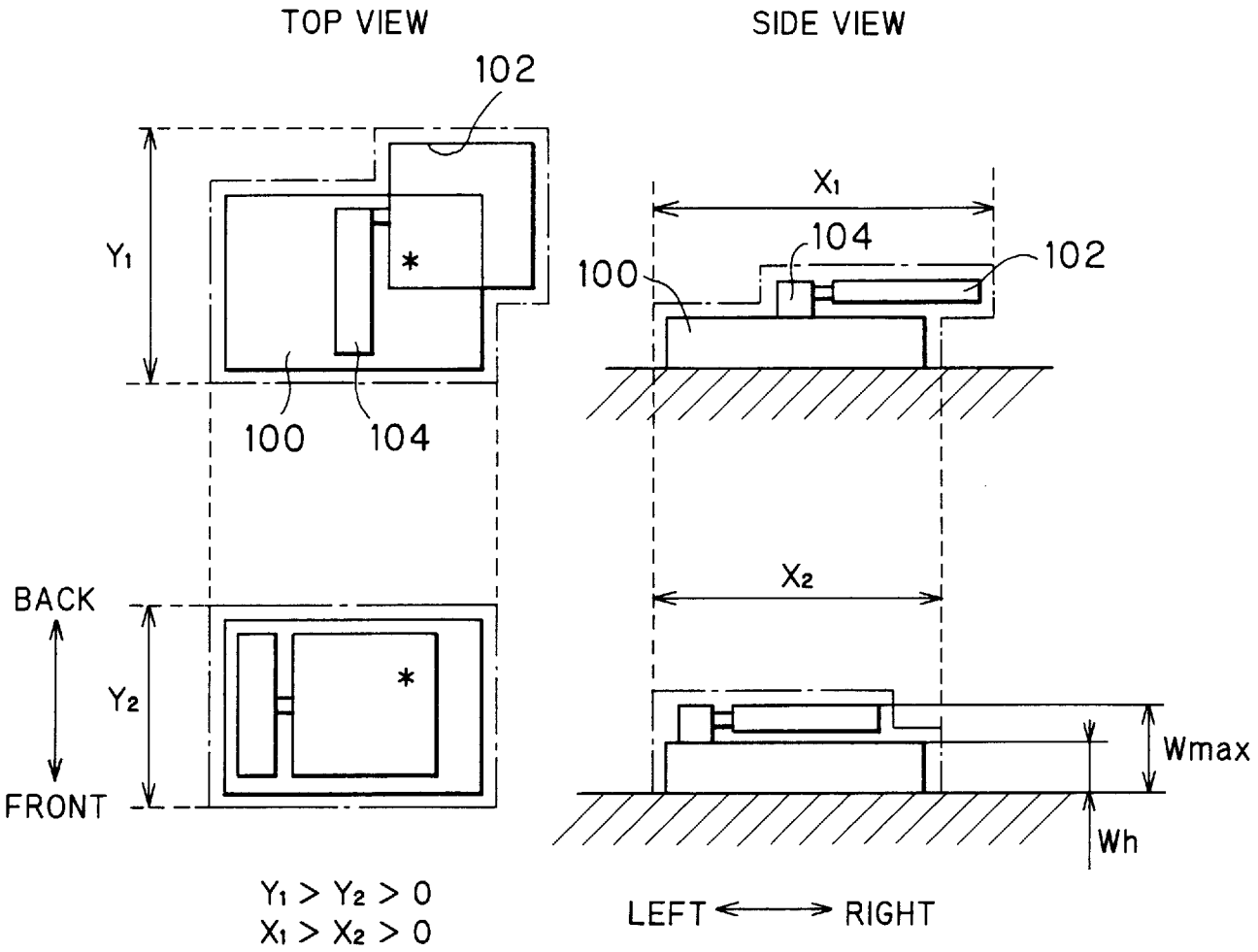
FIG. 9(*a*) is a diagram showing a drive unit in a state not appropriate for storage.

After the sewing process is completed, if the surface area occupied by the drive unit 16 and embroidery frame 36 is large (as shown in FIG. 9(*a*)), in other words, if the drive unit 16 is in a state not appropriate for storage, the user presses the return key to again display the initial screen in the LCD 20 (S24: yes: S18: yes) and presses the portion on the lower part of the screen equivalent to a storage key 48 (S12: yes). The CPU 26 will determine that a command has been input to decrease the surface area occupied by the drive unit 16 and the embroidery frame 36 for storage.

Figure 2:
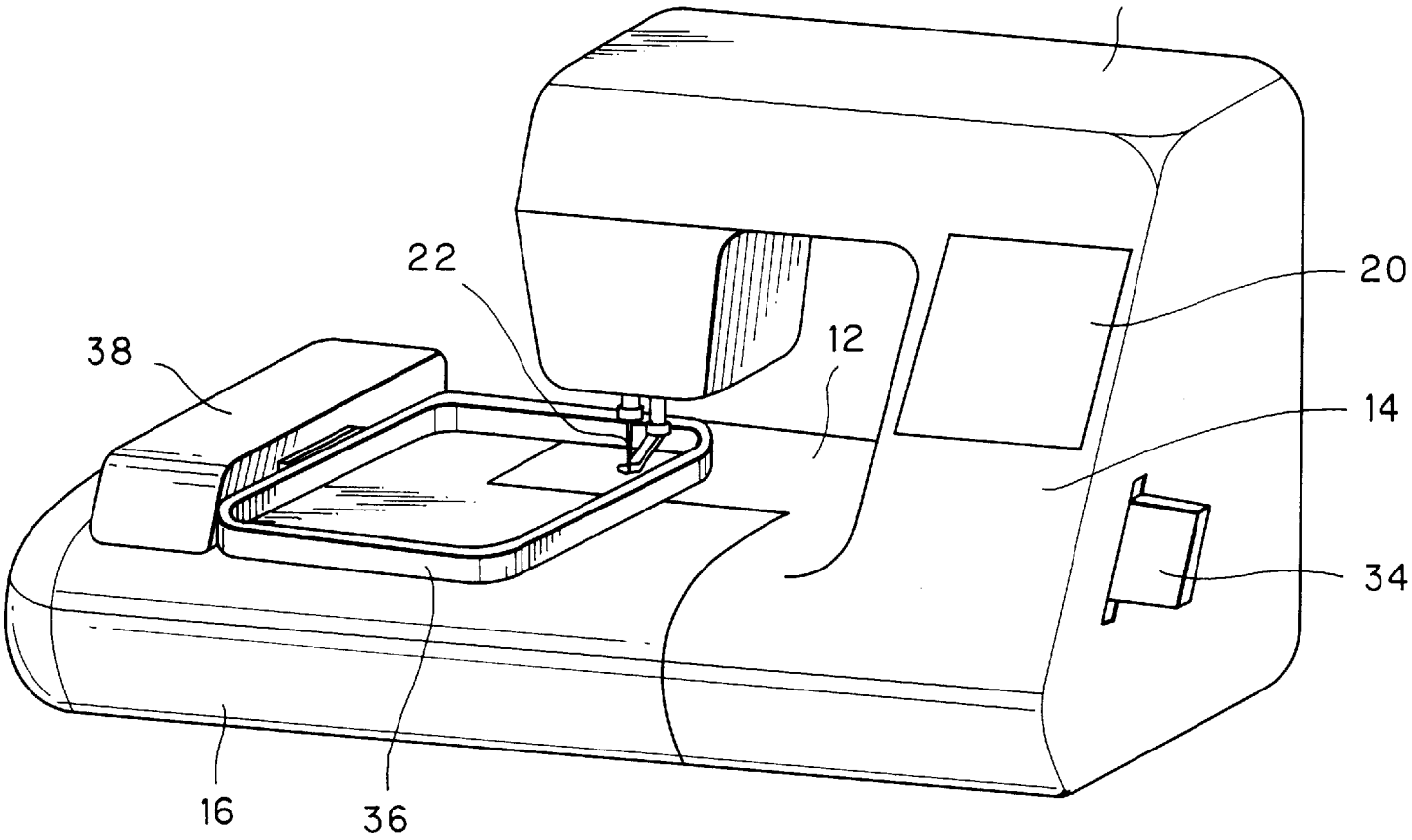
FIG. 2 is a diagram showing a sewing machine of the present invention in a state suitable for storage.

Next, the CPU 26 calculates the amount of drive needed to move the embroidery frame 36 from its current position, which is stored in the nonvolatile memory 25, to the position stored in the ROM 28 (position of the embroidery frame 36 when the drive unit 16 is prepared for storage) (S32). The CPU 26 then drives the Y-direction movement motor 40 and the X-direction movement motor 44 based on the calculation obtained in step S32, moving the embroidery frame 36 (S36) to minimize the surface area occupied by the drive unit 16 and the embroidery frame 36, as shown in FIG. 2 and FIG. 9(*b*). The drive unit 16 is now in a state appropriate for storage. The user removes the drive unit 16 from the sewing machine 10 and stores the drive unit 16, which is now in a state specified for storage, in a specified repository. Note that the embroidery frame 36 is only moved when the sewing needle 22 is raised above a specified level to prevent damage to the sewing needle 22.

Even if the sewing machine 10 stops unexpectedly and must be turned on again, the drive unit 16 can be accurately positioned in the storage state, because the position of the embroidery frame 36 is continually being stored.

The drive unit 16 is tested at the factory to verify that it operates properly with the sewing machine 10 and is packaged and shipped only if the operations are normal. Due to the various tests conducted on the drive unit 16, the Y-direction movement mechanism 38 has not always come to a stop in a specified position once the tests are completed. Shock absorbing members are provided in the packaging box to absorb impacts during shipment. These shock absorbing members contact with the drive unit 16 and are formed and positioned to prevent the drive unit 16 from bouncing around in the box. In most cases, the shock absorbing members must be arranged in predetermined positions in relation not only to the drive unit 16, but to the stopped position of the Y-direction movement mechanism 38. Hence, operation efficiency is low because the user must position the Y-direction movement mechanism 38 using manual operation keys for moving the frame of the sewing machine 10. Therefore, if the user coordinates the stopped position of the Y-direction movement mechanism 38 and the state required to store the drive unit 16 in the box according to the sewing machine described in the embodiment above, the storage operation is made more efficient.

Sometimes the repository for the drive unit 16 is adjacent to other articles, forcing the opening through which the drive unit 16 is inserted into the repository to be of a fixed formation. That is, the positions of the embroidery frame 36 and Y-direction movement mechanism 38 on the drive unit 16 must be specified. Hence, if the drive unit 16 was originally inserted into the repository, the user can accurately reinsert the drive unit 16 into the repository after sewing, by putting the drive unit 16 of the sewing machine described above into a storage state. Storing of the drive unit 16 is made easy, because it can be automatically arranged into a suitable state for storage.

In the embodiment described above, the position of the embroidery frame 36 shown in FIG. 2 is described as the storage position. However, the storage position may not be such a position but a different position may be selected for the operator's convenience. For example, the storage position may be so determined that the Y-direction movement mechanism 38 is in the leftmost position and the embroidery frame 36 is the rearmost position.

Figure 3:
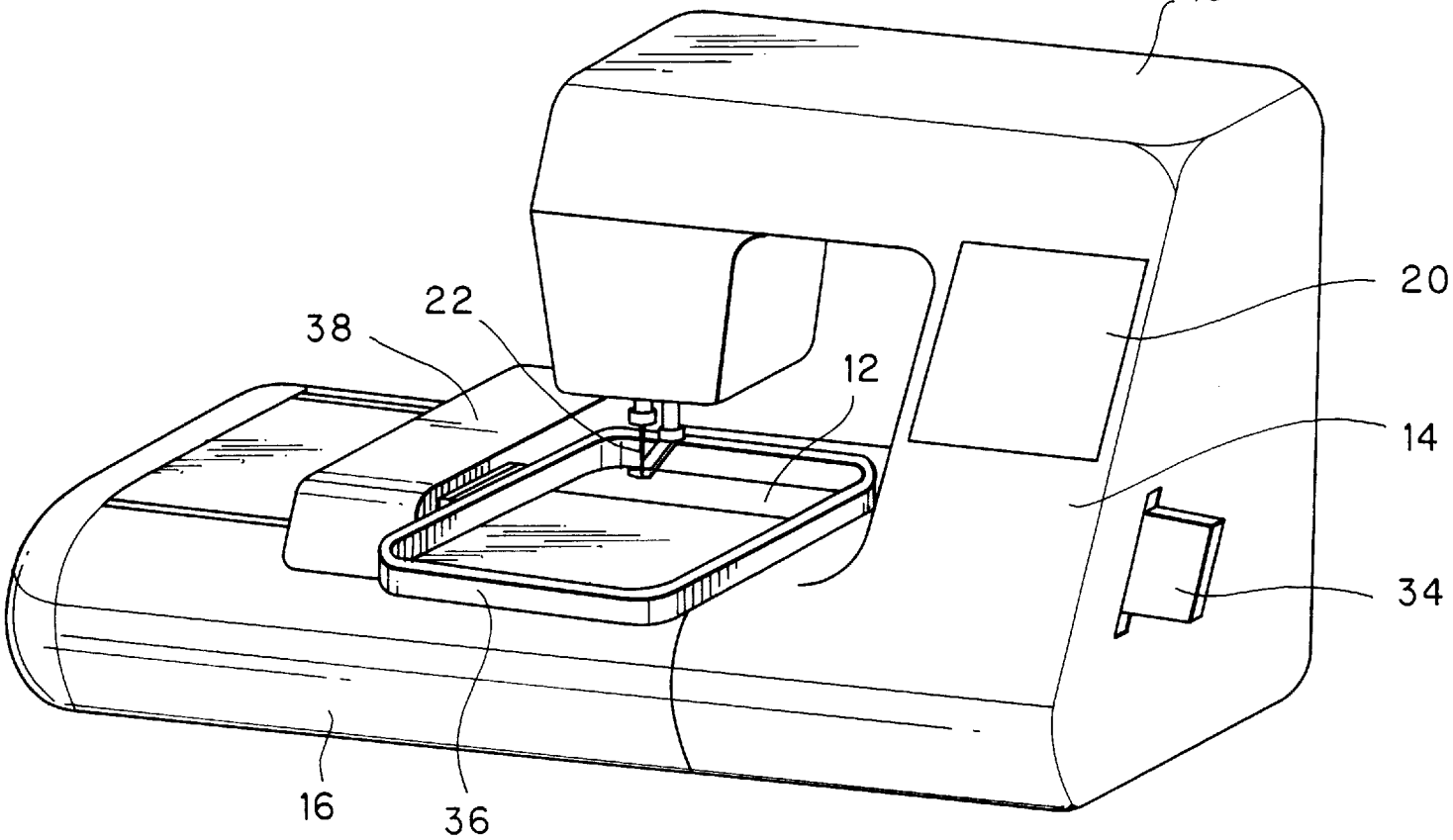
FIG. 3 is a diagram showing the state of a sewing machine of the present invention in which the surface area of the drive unit and the embroidery frame has been decreased.

In the embodiment described above, the surface area of the drive unit 16 and the embroidery frame 36 is made smallest for storage, but the embroidery frame 36 may be moved to a position where the surface area of the drive unit 16 and the embroidery frame 36 could simply be reduced, instead. For example, the embroidery frame 36 could be moved from the position shown in FIG. 1 to that shown in FIG. 3, thereby reducing the width in the front-to-rear direction.

Also, the predetermined storage position described in the embodiment above is fixed at one position, but the user could change the storage positions of the embroidery frame 36 and the Y-direction movement mechanism 38 to any positions that will suit the repository for the drive unit 16. Then, the embroidery frame 36 and the Y-direction movement mechanism 38 will automatically move to the positions set by the user when the user presses the storage key 48.

Figure 10:
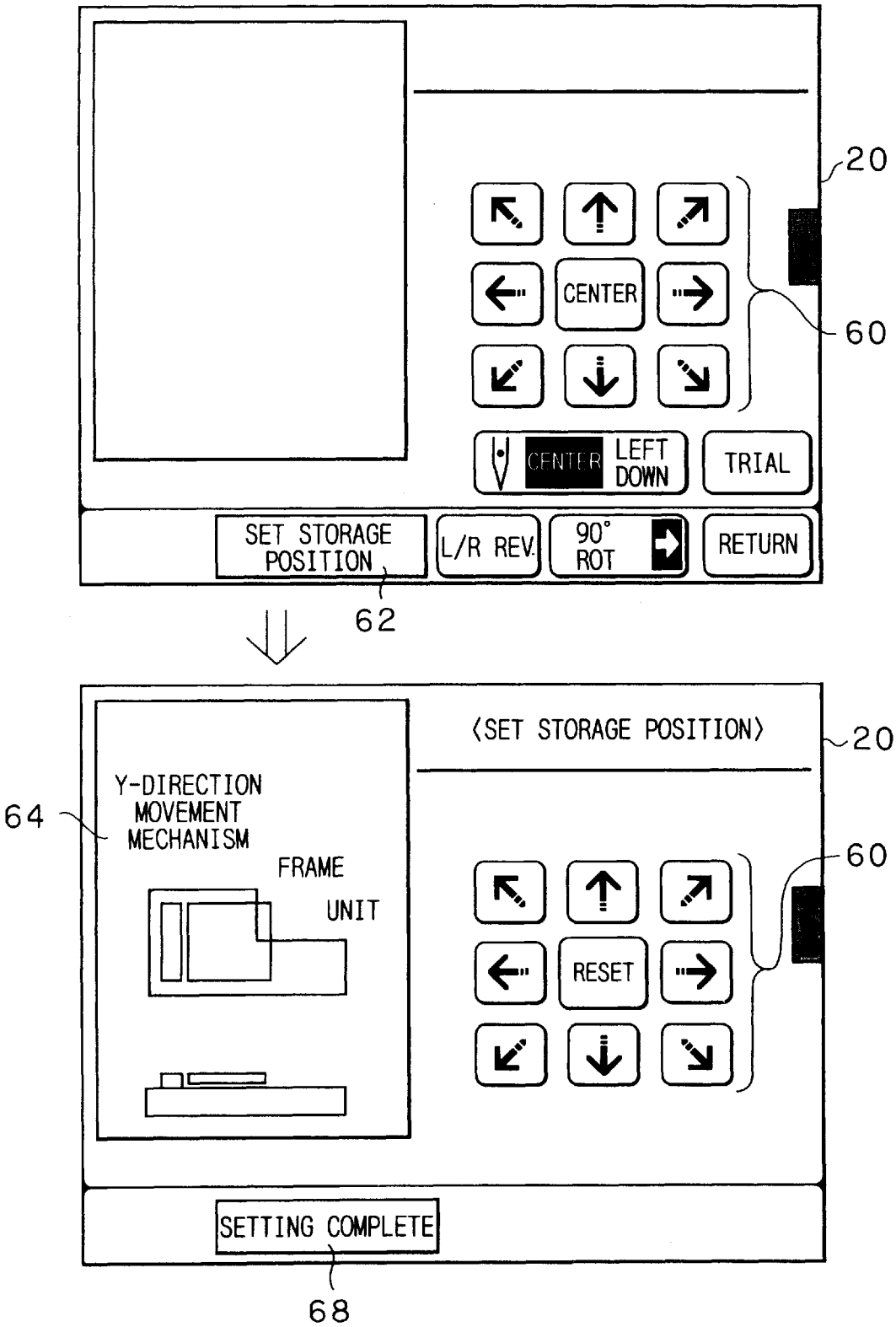
FIG. 10 is a diagram showing display screens on a sewing machine that relates to claim 5 of the present invention.

When the frame movement manual keys 60 are displayed on the LCD 20 as shown in FIG. 10, for example, a set storage position key 62 could be configured to cause the display to change to the lower screen in the diagram when pressed, at which time the storage condition of the drive unit 16 could be set by manipulating the frame movement manual keys 60 while referring to the display. When performing this storage condition setting, the embroidery frame 36 could be configured either to actually move or not to move in response to the frame movement manual keys 60. If the embroidery frame 36 does not actually move at this time, then the storage condition display portion 64 will move in response to the frame movement manual keys 60. Next, data for a new position of the embroidery frame 36 that can be used when storing the drive unit 16 is stored in the nonvolatile memory 25 when the setting complete key 68 is pressed. In this way, various stop positions for the embroidery frame 36 can be set to prepare the drive unit 16 for storage. Although only one type of storage condition was described in the embodiment above, the user could set a plurality of storage conditions and select any one of them as the need arises.

In the embodiment described above, the storage key 48 is displayed only in the initial screen, but the same could be displayed in other screens, such as the pattern select screen, as well. In particular, displaying the storage key 48 at the end of a sewing process would eliminate the extra steps required to return to the initial screen. Also, the process of placing the drive unit 16 in a condition for storage could be linked to the operation of turning off the power switch on the sewing machine 10. This operation would require that the sewing machine 10 had been stopped in a normal state.

In the embodiment above, reduction of the drive unit 16 for a repository was described. Next, storage of the drive unit 16 in a storage container 50 for containing the drive unit 16 will be described.

When manufacturing the storage container 50 for containing the drive unit 16, the storage container 50 would be very large if the width of the storage space is set at the maximum width of the drive unit 16 (the portion containing the Y-direction movement mechanism 38 is at maximum width: Wmax). It is desirable to minimize the size of the storage container 50.

When storing the drive unit 16 in a storage container 50 while the embroidery frame 36 is still attached, the position of the Y-direction movement mechanism 38 for storage is specified, and a storage space (inside the protrusion portion 50a) is formed for storing only the drive unit 16 and the embroidery frame 36 in the position specified. In this way, the storage container 50 can be made smaller than in a condition made suitable for all stop conditions of the embroidery frame 36. The positions of the Y-direction movement mechanism 38 and the embroidery frame 36 can be specified according to the sewing machine 10 of the embodiment described above. In this way, the drive unit 16 can be reliably stored. Moreover, this method prevents the Y-direction movement mechanism 38, embroidery frame 36, and storage container 50 from being damaged by contact with each other and prevents the embroidery frame 36 from dropping out of the drive unit 16.

Further, if the embroidery frame 36 is removed from the drive unit 16 anyway when storing the drive unit 16 in the storage container 50, the storage space other than that taken up by the Y-direction movement mechanism 38 can be set to the width Wh of the main part of the drive unit 16. Hence, a small storage container 50 can be achieved, by providing a storage space of width Wmax for only the portion designed to contain the Y-direction movement mechanism 38, while the remaining portions are provided at width Wh. The position of the Y-direction movement mechanism 38 is similarly specified according to the sewing machine 10 described above. In this way, the drive unit 16 can be reliably stored in the storage container 50. Moreover, this method prevents damage caused by contact between the Y-direction movement mechanism 38 and the storage container 50.

Figure 8:
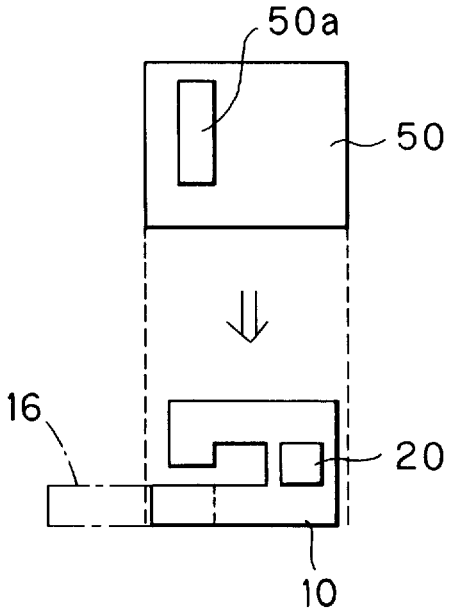
FIG. 8 is a diagram showing a storage container for a sewing machine and drive unit of the present invention.

Further, the storage container 50 for the drive unit 16 and the storage container 50b for the sewing machine 10 can be formed as one unit, as shown in FIG. 8. In this case, an opening portion for inserting the sewing machine 10 is formed on the lower surface, and a front surface portion 50c on the storage container 50 can be opened and closed for inserting the drive unit 16.

As can be appreciated from the above description, storage space for the support frame drive unit can be made small by reducing the area occupied by the support frame drive unit and the support frame. In addition, storage is facilitated by leaving the support frame attached, thereby reducing the trouble of removing the support frame and the possibility of losing the same.

When the need arises, the user can input a command to begin reducing the area occupied by the support frame drive unit and the support frame. The support frame drive unit can then be smoothly stored, providing there are no obstructions in the storage area.

The support frame drive unit can be detached from the sewing machine and stored in a storage container designed for containing the support frame drive unit. Also, the support frame drive unit can be inserted into the storage container while mounted with the support frame. This method prevents damage caused by contact between the support frame and the storage container and prevents the support frame from dropping out of the support frame drive unit. Further, the process of arranging the support frame in a position suitable for storage is greatly reduced.

The stop condition of the support frame drive unit is set by the user, enabling the support frame drive unit to conform to many storage conditions.

What is claimed is:

1. A sewing machine comprising:

a sewing machine body;

a needle vertically movable for stitching a workpiece cloth;

a support frame for supporting the workpiece cloth;

a support frame drive unit having a frame movement mechanism for moving said support frame with respect to said needle, said support frame drive unit being detachably connected to said sewing machine body;

control means for controlling said frame movement mechanism so as to move said support frame to a predetermined position at which said support frame drive unit and said support frame occupy a reduced area; and a manual operation button, said manual operation button, when pressed, inputting a start instruction into said control means, the start instruction causing said control means to control said frame movement mechanism to move said support frame to the predetermined position.

2. A sewing machine according to claim 1, further comprising storage means for storing an updated position of said support frame and a predetermined storage position.

3. A sewing machine according to claim 2, wherein when said manual operation button is pressed, said frame movement mechanism moves said support frame from the updated position to the predetermined storage position.

4. A sewing machine according to claim 3, wherein said storage means comprises a nonvolatile memory for storing the updated position of said support frame, whereby the updated position of said support frame remains unerased even if the sewing machine is powered off.

5. A sewing machine according to claim 2, wherein said storage means stores a plurality of different predetermined storage positions.

6. A sewing machine according to claim 5, wherein when said manual operation button is pressed, said frame movement mechanism moves said support frame from the updated position to a selected one of the plurality of different predetermined storage positions.

7. A sewing machine according to claim 1, further comprising a set of manual frame movement keys for moving said support frame with respect to said needle.

8. A sewing machine according to claim 7, further comprising a display for displaying a positional relationship between said support frame drive unit and said support frame.

9. A sewing machine according to claim 8, wherein a position to which said support frame drive unit is moved is settable with said set of manual frame movement keys while viewing the positional relationship between said support frame drive unit and said support frame displayed in said display, and wherein said frame movement mechanism moves said support frame to the position to reduce the area occupied by said support frame drive unit and said support frame.

10. A sewing machine according to claim 1, wherein when said support frame drive unit detached from said sewing machine body is to be stored in a storage container having an inner accommodating space, said control means controls said frame movement mechanism to move said support frame in a position where said support frame drive unit and said support frame are fittedly insertable into the inner accommodating space of the storage container.

11. A system including a sewing machine and a storage container, comprising:

a needle vertically movable for stitching a workpiece cloth;

a support frame for supporting the workpiece cloth;

a support frame drive unit having a frame movement mechanism for moving said support frame with respect to said needle;

a sewing machine body to which said support frame drive unit is detachably mounted;

a storage container for containing said support frame drive unit after said support frame drive unit is detached from said sewing machine body; and control means for controlling said frame movement mechanism so as to provide said support frame drive unit in a predetermined condition for insertion into the storage container.

12. A sewing machine system according to claim 11, further comprising a manual operation button, said manual operation button, when pressed, inputting a start instruction into said control means, the start instruction causing said control means to provide said support frame drive unit in the predetermined condition.

13. A sewing machine system according to claim 12, further comprising storage means for storing an updated position of said support frame and a predetermined storage position.

14. A sewing machine system according to claim 13, wherein when said manual operation button is pressed, said frame movement mechanism moves said support frame from the updated position to the predetermined storage position.

15. A sewing machine system according to claim 14, wherein said storage means comprises a nonvolatile memory for storing the updated position of said support frame, whereby the updated position of said support frame remains unerased even if the sewing machine is powered off.

16. A sewing machine system according to claim 13, wherein said storage means stores a plurality of different predetermined storage positions.

17. A sewing machine system according to claim 16, wherein when said manual operation button is pressed, said frame movement mechanism moves said support frame from the updated position to a selected one of the plurality of different predetermined storage positions.

18. A sewing machine system according to claim 11, further comprising a set of manual frame movement keys for moving said support frame with respect to said needle.

19. A sewing machine system according to claim 18, further comprising a display for displaying a positional relationship between said support frame drive unit and said support frame.

20. A sewing machine system according to claim 19, wherein a position to which said support frame drive unit is moved is settable with said set of manual frame movement keys while viewing the positional relationship between said support frame drive unit and said support frame displayed in said display.

21. A sewing machine comprising:

a needle vertically movable for stitching a workpiece cloth;

a support frame for supporting the workpiece cloth;

a support frame drive unit having a frame movement mechanism for moving said support frame with respect to said needle;

a sewing machine body to which said support frame drive unit is detachably mounted;

setting means for setting a stop position of said frame movement mechanism;

memory means for storing a plurality of stop positions set by said setting means; and control means for controlling said frame movement mechanism to move to a selected one of the plurality of stop positions.

22. A sewing machine according to claim 21, further comprising a display for displaying a positional relationship between said support frame drive unit and said support frame.

23. A sewing machine according to claim 22, further comprising a set of manual frame movement keys for moving said support frame with respect to said needle, wherein the stop position is settable with said set of manual frame movement keys while viewing the positional relationship between said support frame drive unit and said support frame displayed in said display.

* * * * *

UNITED STATES PATENT AND TRADEMARK OFFICE

CERTIFICATE OF CORRECTION

PATENT NO. : 5,868,088
DATED : February 9, 1999
INVENTOR(S) : Tomohiko MORI and Seijiro OKUDA It is certified that error appears in the above-identified patent and that said Letters Patent is hereby corrected as shown below:

On the title page,

Item [73] Assignee: Brother Kogyo Kabushiki Kaisha
Nagoya, Japan

Signed and Sealed this

First Day of June, 1999

*Attest:*

Q. TODD DICKINSON

*Attesting Officer*

*Acting Commissioner of Patents and Trademarks*